US005411387A

United States Patent [19]

Lundin et al.

[11] Patent Number: 5,411,387

[45] Date of Patent: May 2, 1995

[54] ROTARY DISPLACEMENT COMPRESSOR HAVING ADJUSTABLE INTERNAL VOLUME RATIO AND A METHOD FOR REGULATING THE INTERNAL VOLUME RATIO

[75] Inventors: Stig Lundin, Värmdö ; Hakan Saletti, Tyresö , both of Sweden

[73] Assignee: Svenska Rotor Maskiner AB, Stockholm, Sweden

[21] Appl. No.: 140,051

[22] PCT Filed: May 12, 1992

[86] PCT No.: PCT/SE92/00306

§ 371 Date: Oct. 29, 1993

§ 102(e) Date: Oct. 29, 1993

[87] PCT Pub. No.: WO92/20924

PCT Pub. Date: Nov. 26, 1992

[30] Foreign Application Priority Data

May 14, 1991 [SE] Sweden ..... 9101448

[51] Int. Cl.[6] ..... F01C 1/16

[52] U.S. Cl. ..... 418/201.2; 418/2; 73/592; 417/63

[58] Field of Search ..... 73/592, 646; 418/1, 418/2, 201.2; 417/63

[56] References Cited

U.S. PATENT DOCUMENTS

| | | | |
|---|---|---|---|
| 3,936,239 | 2/1976 | Shaw . | |
| 4,362,472 | 12/1982 | Axelsson . | |
| 5,018,948 | 5/1991 | Sjoholm et al. | 418/201.1 |

FOREIGN PATENT DOCUMENTS

| | | | |
|---|---|---|---|
| 127878 | 10/1977 | German Dem. Rep. . | |
| 0265382 | 11/1986 | Japan | 418/201.1 |
| 0092593 | 4/1991 | Japan | 418/2 |
| 430709 | 12/1983 | Sweden . | |
| 2052641 | 1/1981 | United Kingdom . | |
| WO89/03482 | 4/1989 | WIPO . | |

OTHER PUBLICATIONS

Patent Abstracts of Japan, vol. 8, No. 154, vol. 8, No. 154, M 310 abstract of JP 59–49392 published Mar. 21, 1094.

*Primary Examiner*—Richard A. Bertsch
*Assistant Examiner*—Charles G. Freay
*Attorney, Agent, or Firm*—Goodman & Woodward Frishauf, Holtz

[57] ABSTRACT

A rotary displacement compressor has an adjustable regulator (22) which determines the internal volume ratio of the compressor. The regulator (22) is adjusted in response to the sound level of a sound of compressed working medium, which is sensed by a sound sensor (26) located adjacent to the outlet port (20 ) of the compressor.

14 Claims, 1 Drawing Sheet

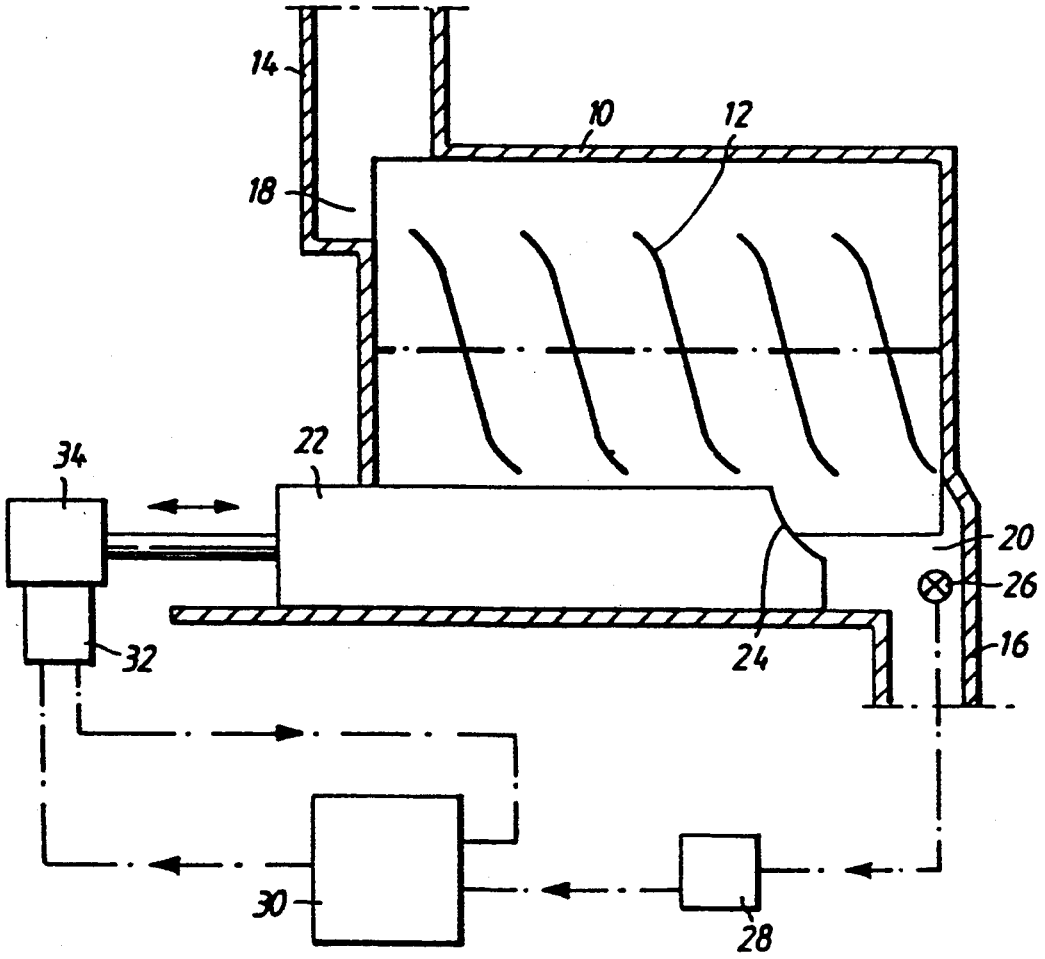
14
10
12
18
34
22
20
26
16
32
24
30
28

ROTARY DISPLACEMENT COMPRESSOR HAVING ADJUSTABLE INTERNAL VOLUME RATIO AND A METHOD FOR REGULATING THE INTERNAL VOLUME RATIO

BACKGROUND OF THE INVENTION

The present invention relates to a rotary displacement compressor having adjustable regulating means for determining the internal volume ratio of the compressor, and to a method for regulating the internal volume ratio of such a compressor.

The internal compression of a compressor is independent of the pressure in the pressure channel and is, for a certain working fluid, dependent only on the volume ratio of the compressor, i.e. the relation between the volume of a compression chamber at the moment it just has been closed off from the inlet port and the volume of a compression chamber at the moment just before it is opened towards the outlet port. Assuming a constant inlet pressure, a certain volume ratio thus results in a certain pressure in a compression chamber just before it is opened towards the outlet port. This is called the end pressure of the compressor. It is desirable that the internal compression corresponds to the pressure in the pressure channel, so that the pressure in a compression chamber just before it opens towards the outlet port equals the pressure in the pressure channel. If these pressures differ from each other, i.e. at overcompression or undercompression, a rapid flow of gas through the outlet port occurs each time a compression chamber opens towards it, whereby the pressures become equalized. The flow velocity of the working fluid during this short period of time is much higher than the flow velocity of the working fluid when it is displaced out through the outlet port by the rotors, and the direction thereof can be to or from the pressure channel, depending on whether there is overcompression or undercompression. These flow pulses consume power and as a consequence the efficiency of the compressor will decrease. For these reasons, there is always an effort to adapt the built-in volume ratio of the compressor to the pressure in the pressure channel.

In some cases this pressure, however, can vary. This makes it desirable to correspondingly make it possible to vary the volume ratio. It is known to provide a compressor with devices for regulating the volume ratio; so called $V_i$-regulation. This is accomplished in that the position of the edge of the outlet port, which determines the moment or timing of opening, can be varied in steps or continuously. By this technique, the volume of a compression chamber at the moment of opening can be changed and therewith the volume ratio is changed. In this way it can be achieved that the pressure in said compression chamber roughly equals the pressure in the pressure channel.

Constructively this can be accomplished in many ways, partly depending on which kind of rotary displacement compressor is involved. On, for example, a rotary screw compressor having two cooperating rotors, a frequently used regulating device comprises an axially movable slide, displaceably mounted in guiding means parallel to the rotors. The slide has a surface facing the working space, which surface forms a part of the barrel wall of the working space and complies with its shape. The end of the slide facing the high pressure end of the compressor is provided with an edge forming an edge of the outlet port. When the position of said edge is changed by displacement of the slide, the moment of opening of a compression chamber towards the outlet port will be changed and with this, its volume at that moment is changed.

For adjusting the slide to a correct position, where neither undercompression nor overcompression prevails, it is known to have the slide position influenced by sensed operating parameters of the compressor. Examples of such devices are disclosed in Swedish patent publication Nos. SE 427 063 and SE 430 709, German patent publication No. DD 127 878, U.S. Pat. No. 3,936,239 and International Publication No. WO89/03482. The operating parameters sensed in the compressors disclosed in the above-mentioned patent documents are either the electrical power consumption of the prime mover, the difference between the outlet pressure and the pressure in a compression chamber just before opening, or the flow direction in a channel connecting the working space to the outlet channel. In the first alternative, the slide is adjusted to a position where the power consumption is at its minimum, which corresponds to a minimum of losses in efficiency due to undercompression or overcompression. In the second alternative, the pressure in the compression chamber affects the slide to move in a direction of larger outlet area, whereas the pressure in the pressure channel affects the slide to move in the opposite direction so that these pressures balance each other. In WO 89/03482, a channel connects the outlet channel to a working chamber just before it starts to open towards the outlet port. The flow direction of working fluid in this connection channel is indicative of whether the pressure in the working chamber is higher or lower than the pressure in the outlet channel. The regulating slide is adjusted to a position where the flow through the connection channel is at zero, which means that said pressures are equal.

These known ways of governing the $V_i$-regulation entail various drawbacks.

Using the power consumption as the governing parameter introduces a source of error in that fluctuations in the electrical supply network affects the sensed parameter. Furthermore, the power consumption as a function of the deviations of the end pressure in the compressor from the pressure in the pressure channel has a very flat characteristic, resulting in a poor accuracy, which allows the influence of said fluctuations to be relatively dominating.

To use the pressure difference for governing the regulation has shown to be difficult to work in practice. The main reason for that is that sensing the end pressure in the compressor cannot be accomplished in a reliable way, since the sensed pressure fluctuates, and considerable pressure pulses are generated each time the means for limiting a compression chamber passes the sensing point. It will therefore be practically impossible to use this technique for reaching a balanced position where neither undercompression nor overcompression prevails.

SUMMARY OF THE INVENTION

The object of the present invention therefore is to find a better way for governing the adjustment of the built-in volume ratio of a rotary displacement compressor.

According to a first aspect of the invention, a rotary screw compressor is provided with a sound sensor adjacent to the outlet port of the compressor, means for registering the sound level of the sound of compressed working medium sensed by said sound sensor, and a governor connected to said registering means and controlling a regulator in response to the registered sound level of said sound.

According to a second aspect of the invention, a method for regulating the internal volume ratio of the compressor includes the steps of sensing the sound of a compressed working medium by a sound sensor arranged adjacent to the outlet port of the compressor, registering the sound level of said sensed sound, and adjusting a regulator in response to the registered sound level of said sound.

The invention is based on the insight that the above discussed flow pulses, which occur when a working chamber starts to open towards the outlet, create a sound, and that the sound level thereof is dependent on how large these pulses are. The more the end pressure deviates from the delivery pressure, the more powerful are these pulses and the higher is the sound level of the sound thus created.

Measuring the sound level adjacent to the outlet port thus delivers information in this respect. When the sound level is at a minimum, this means that the internal volume ratio of the compressor matches the delivery pressure. A change in the delivery pressure then results in that the sound level increases, thus indicating overcompression or undercompression and indicating that the regulator should be adjusted accordingly.

Although the invention can be applied to various types of rotary displacement compressors having either continuous $V_i$-regulation or stepwise regulation through lift valves, it is particularly suitable for rotary screw compressors having an axially adjustable slide valve for regulating the internal volume ratio.

The invention can advantageously be carried out by using a micro-processor for governing the regulator in response to the signals from the sound sensor.

BRIEF DESCRIPTION OF THE DRAWINGS

The single Figure shows a schematic section through a compressor according to a preferred embodiment of the invention.

DETAILED DESCRIPTION OF THE PREFERRED EMBODIMENT

The compressor illustrated in the Figure is of the rotary screw type having a pair of intermeshing rotors 12 (of which only one can be seen in the Figure). The surrounding casing 10 has the shape of two intersecting cylinders, each cylinder housing one of the rotors 12. The rotors 12 are provided with helical lobes and intermediate grooves forming chevron-shaped working chambers. The working fluid (i.e., the working medium) is supplied to the working space from an inlet channel 14 through an inlet port 18 and leaves the compressor through an outlet port 20 to an outlet channel 16. Along one of the intersecting lines of the cylinders an axially movable regulating slide 22 is provided. The regulating slide 22 forms a part of the casing limiting the working space and has a front edge 24 forming an edge of the outlet port 20. The axial position of the front edge 24 determines the moment when a closed working chamber starts to open towards the outlet port 20. The more to the right in the Figure this edge 24 is located, the smaller is the volume of the working chamber at the opening moment. By means of the regulating slide 22, the internal volume ratio thus can be regulated when axially adjusting the same. The compressor is provided with means through which the regulating slide 22 is moved to a position where the internal volume ratio is such that the end pressure in the working chamber equals the pressure in the outlet channel 16.

The means for adjusting the position of the regulating slide 22 includes a sound sensing device 26 provided in the outlet channel 16 adjacent to the outlet port 20. The sound level sensed by the sound sensing device 26 is registered by a registering unit 28. By an actuating device 34 the regulating slide 22 is adjusted to a position where the registered sound level is at a minimum.

Although this adjustment could be accomplished manually, the preferred embodiment shown in the Figure is provided with means for automatically performing this operation. These means include a micro-processor 30 and a governing unit 32 governing the position of the regulating slide 22. Signals indicating the sound level registered by the registering device 28 are received by the micro-processor 30. These signals are stored in the micro-processor 30 and each signal is compared with the preceding received signal. If the difference between the sound levels indicated by these two signals exceeds a predetermined value, an output signal goes from the micro-processor 30 to the governing unit 32 for initiating movement of the regulating slide 22. In the memory of the micro-processor 30 also is stored information about in which direction the regulating slide 22 was moved during the last preceding adjustment. This information is received as a feedback signal from the governing unit 32 to the micro-processor 30. If the signal from the registering unit 28 indicates a higher sound level than the preceding signal, the governing unit 32 initiates adjustment of the regulating slide 22 in a direction opposite to the preceding adjustment. When a signal from the registering unit 28 indicates a lower sound level than the preceding signal, the governing unit 32 initiates adjustment of the regulating slide 22 in the same direction as the preceding adjustment. And when a signal from the registering unit 28 indicates a sound level which is equal to that of the preceding signal, there will be no adjusting movement. In practice, equal here means that the difference between the indicated sound levels is below a certain value.

If the compressor is working at a correct internal volume ratio, any change in the delivery pressure will result in overcompression or undercompression. By the sound level registration and the means described above, this will start an adjustment of the regulating slide 22 until the sound level reaches its minimum again, and the compressor will continue to work at the new internal volume ratio adapted to the changed delivery pressure.

It is desirable to avoid that the system also reacts to minor fluctuations in the sound level, due to changes in the delivery pressure which are so small that there is no practical need to compensate for them. Therefore, the micro-processor 30 is so programmed that the difference between an indicated sound level and the preceding indication has to exceed a certain minimum difference in order to create a signal ordering adjustment.

In the description above, difference thus means a difference above this minimum difference, and equal means that the difference is below this minimum difference. However, such a system would not be able to react to a slow but substantial change in delivery pressure, since the difference between each two consecutive sound level indications in this case could be below that minimum, even if the signals represent a considerable change when added. The micro-processor 30 thus has to have the ability to handle such a situation. Therefore, the feedback signal to the micro-processor 30 from the governing unit 32 indicates whether this is activated for adjustment of the regulating slide 22 or if it is inactive. If the signal indicates inactivation, the micro-processor 30 not only stores the latest preceding sound level indication, but also the lowest sound level indication since the last adjusting movement. The comparing function of the micro-processor 30 in this situation compares the incoming sound level indicating signal with both the latest preceding sound level indication and said lowest sound level indication and reacts to initiate adjustment movement of the regulating slide 22 if any of these comparisons shows a difference above the predetermined minimum difference.

By the means described above, the compressor will all the time be adapted to the delivery pressure by changing the internal volume ratio in response to the changes in the sensed sound level.

The actuating device 34 preferably is a hydraulic piston, frequently used for slide valve adjustment in rotary screw machines, in which case the governing unit 32 takes the form of valves, which close or open responsive to signals from the micro-processor 30. Actuation by electrical means or mechanically, e.g. using a worm and pinion, of course also are possibilities obvious to those skilled in the art. Since applications of the different types of actuating means are well known in the field and since they form no essential part of the invention, a description of their function is not necessary.

In the described embodiment, the adjustable regulating means comprises a displaceable slide valve, which is suitable when continuous regulation is desired. The invention, however, can as well be employed when the regulation is effectuated stepwise, e.g. by means of lift valves, the opening and closing of which is controlled by the sensed sound level.

We claim:

1. In a rotary displacement compressor having an inlet port (18), an outlet port (20), working chambers arranged to receive a working medium from said inlet port (18) and for outputting compressed working medium to said outlet port (20), an adjustable regulator (22) for determining the internal volume ratio of the compressor, the improvement comprising:

a sound sensor (26) arranged adjacent to the outlet port (20) of the compressor for sensing a sound of the compressed working medium;

registering means (28,30) for registering a sound level of the sound of the compressed working medium as sensed by said sound sensor (26); and a governor (32) coupled to said registering means (28,30) for controlling said adjustable regulator (22) in response to a registered sound level of said sensed sound of said compressed working medium, to thereby control the internal volume ratio of the compressor in response to the registered sound level of said sensed sound.

2. The compressor of claim 1, wherein:

the compressor is a rotary screw type compressor having a pair of intermeshing helical rotors (12) comprising said working chambers; and said adjustable regulator (22) comprises an axially displaceable slide valve which is displaceable for determining a moment when a closed working chamber of the compressor starts to communicate with said outlet port (20) of the compressor.

3. The compressor of claim 2, wherein said registering means (28,30) and said governor (32) control said adjustable regulator (22) such that said adjustable regulator (22) is adjusted to a position where said sound level of said sound sensed by said sound sensor (26) is substantially at a minimum level.

4. The compressor of claim 3, wherein said registering means (28,30) includes a micro-processor (30) for storing, comparing and processing values of said registered sound level, to operate said governor (32) to control said adjustable regulator (22).

5. The compressor of claim 1, wherein said registering means (28,30) includes a micro-processor (30) for storing, comparing and processing values of said registered sound level.

6. The compressor of claim 1, wherein said registering means (28,30) and said governor (32) control said adjustable regulator (22) such that said adjustable regulator (22) is adjusted to a position where said sound level of said sound sensed by said sound sensor (26) is substantially at a minimum level.

7. A method for regulating an internal volume ratio of a rotary displacement compressor having an inlet port (18), an outlet port (20), working chambers arranged to receive a working medium from said inlet port (18) and for outputting a compressed working medium to said outlet port (20), and an adjustable regulator (22) for regulating the internal volume ratio of the compressor, comprising the steps of:

sensing a sound of the compressed working medium by a sound sensor (26) arranged adjacent to the outlet port (20) of the compressor;

registering a sound level of said sound sensed by said sound sensor (26); and adjusting said adjustable regulator (22) in response to the registered sound level of said sensed sound of said compressed working medium.

8. The method according to claim 7, wherein:

the working medium is compressed by a pair of intermeshing helical rotors (12) comprising said working chambers;

said adjustable regulator (22) comprises an axially displaceable slide valve (22); and said adjusting step comprises axially displacing said slide valve (22) in response to said registered sound level for determining a moment when a closed working chamber starts to communicate with said outlet port (20) of said compressor.

9. The method according to claim 8, wherein said step of axially displacing said slide valve (22) comprises adjusting said axially displaceable slide valve (22) to a position where said sound level of said sensed sound is substantially at a minimum value.

10. The method according to claim 7, wherein said step of adjusting said adjustable regulator (22) comprises adjusting said adjustable regulator (22) to a position where said sound level of said sensed sound is substantially at a minimum value.

11. The method according to claim 10, wherein said step of adjusting said adjustable regulator (22) further comprises providing a micro-processor (30) for receiving input signals representing registered sensed sound levels of said compressed working medium, and for storing, comparing and processing said received signals and producing output signals for effectuating adjustment of said adjustable regulator (22).

12. The method according to claim 9, wherein said step of adjusting said adjustable regulator (22) further comprises providing a micro-processor (30) for receiving input signals representing registered sensed sound levels of said compressed working medium, and for storing, comparing and processing said received signals and producing output signals for effectuating adjustment of said adjustable regulator (22).

13. The method according to claim 8, wherein said step of adjusting said adjustable regulator (22) further comprises providing a micro-processor (30) for receiving input signals representing registered sensed sound levels of said compressed working medium, and for storing, comparing and processing said received signals and producing output signals for effectuating adjustment of said adjustable regulator (22).

14. The method according to claim 7, wherein said step of adjusting said adjustable regulator (22) further comprises providing a micro-processor (30) for receiving input signals representing registered sensed sound levels of said compressed working medium, and for storing, comparing and processing said received signals and producing output signals for effectuating adjustment of said adjustable regulator (22).

* * * * *